US009525229B2

(12) United States Patent
Sawada et al.

(10) Patent No.: US 9,525,229 B2
(45) Date of Patent: Dec. 20, 2016

(54) TERMINAL

(71) Applicant: YAZAKI CORPORATION, Minato-ku, Tokyo (JP)

(72) Inventors: Tsutomu Sawada, Shizuoka (JP); Tomokazu Iwami, Shizuoka (JP); Hirotaka Fukushima, Shizuoka (JP); Takashi Tsukamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/634,983

(22) Filed: Mar. 2, 2015

(65) Prior Publication Data

US 2015/0180151 A1 Jun. 25, 2015

Related U.S. Application Data

(63) Continuation of application No. PCT/JP2013/073903, filed on Sep. 5, 2013.

(30) Foreign Application Priority Data

Sep. 6, 2012 (JP) ..... 2012-195793

(51) Int. Cl.
*H01R 13/03* (2006.01)
*H01R 13/04* (2006.01)
*H01R 13/193* (2006.01)

(52) U.S. Cl.
CPC ..... *H01R 13/03* (2013.01); *H01R 13/04* (2013.01); *H01R 13/193* (2013.01)

(58) Field of Classification Search
CPC ..... H01R 13/04; H01R 13/05; H01R 13/052; H01R 13/55; H01R 13/57; H01R 13/08; H01R 13/03
USPC ..... 439/866, 883, 825, 826, 827, 346
See application file for complete search history.

(56) References Cited

U.S. PATENT DOCUMENTS 3,858,956 A * 1/1975 Garrett ..... H01R 13/652 439/106
4,374,607 A * 2/1983 Bright ..... H01R 13/20 439/265
4,687,274 A * 8/1987 Suh ..... H01R 11/01 439/426

FOREIGN PATENT DOCUMENTS

| | | | |
|---|---|---|---|
| CN | 201340928 | Y | 11/2009 |
| JP | S51-6694 | Y2 | 2/1976 |
| JP | S54-64286 | | 10/1978 |
| JP | H01-26062 | Y2 | 8/1989 |
| JP | 2000-188028 | A | 7/2000 |
| JP | 2011-228061 | A | 11/2011 |
| JP | 2012-018869 | A | 1/2012 |
| JP | 2013-168278 | A | 8/2013 |

OTHER PUBLICATIONS

The extended European search report issued on Mar. 3, 2016 in the counterpart European patent application.

(Continued)

*Primary Examiner* — Ross Gushi
(74) *Attorney, Agent, or Firm* — Mots Law, LLP

(57) ABSTRACT

A terminal having a dissimilar material different from a contact base material, the dissimilar material arranged on a surface of a sliding contact portion on which a mating terminal slides includes a groove provided in the sliding contact portion in a direction different from a sliding direction of the mating terminal.

7 Claims, 5 Drawing Sheets

(56) References Cited

OTHER PUBLICATIONS

Official Action issued on Apr. 1, 2016 in the counterpart Chinese application.
Official Action issued on May 10, 2016 in the counterpart Japanese application.
Official Action issued on Jul. 19, 2016 in the counterpart Japanese application.
Official Action issued on Jul. 19, 2016 in the counterpart Chinese application.

* cited by examiner

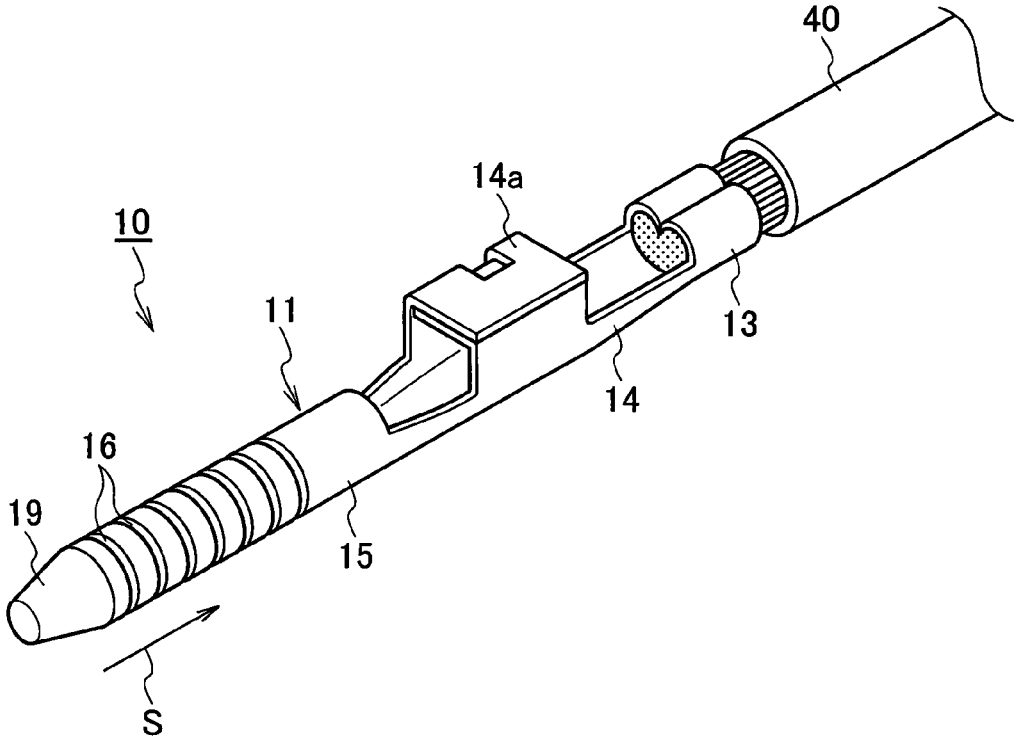
40
14a
10
11
13
14
16
19
15
S

TERMINAL

CROSS REFERENCE TO RELATED APPLICATIONS

This application is a Continuation of PCT Application No. PCT/JP2013/073903, filed on Sep. 5, 2013, and claims the priority of Japanese Patent Application No. 2012-195793, filed on Sep. 6, 2012, the content of both of which is incorporated herein by reference.

TECHNICAL FIELD

The present invention relates to a terminal in which a surface of a sliding contact portion is modified by plating or the like.

BACKGROUND ART

There is a terminal whose sliding contact portion comes into contact with a sliding contact portion of a mating terminal due to sliding against the mating terminal (see Patent Literature 1). A surface of the sliding contact portion of such a terminal may be provided with a metal material that is a dissimilar material different from a contact base material (for example, with silver plated on a copper material of the contact base material). In this case, the same metal material (the same silver plating) as the dissimilar material of the terminal is also applied to the sliding contact portion of the mating terminal. By performing such surface modification, contact resistance and sliding resistance at a position where these sliding contact portions come into contact with each other are reduced.

CITATION LIST

Patent Literature

Patent Literature 1: Japanese Patent Laid-Open Publication No. 2000-188028

SUMMARY OF INVENTION

Technical Problem

However, if the same metal material is arranged on the surfaces of the sliding contact portions of both terminals by plating or the like, in particular, abrasion powder due to adhesion (hereinafter referred to as adhesion abrasion powder) easily occurs. If the abrasion powder due to adhesion lies between both sliding contact portions, the sliding resistance increases, so that operability decreases. In particular, large particles of adhesion abrasion powder accelerate increase of abrasion of the contacts.

Therefore, the present invention is made to solve the problem described above, and has an object to provide a terminal that can prevent increase of the sliding resistance caused by the abrasion powder due to adhesion as much as possible.

Solution to Problem

The present invention is a terminal having a dissimilar material different from a contact base material, the dissimilar material arranged on a surface of a sliding contact portion on which a mating terminal slides, the terminal including a groove provided in the sliding contact portion in a direction different from a sliding direction of the mating terminal.

It is preferable that the direction of the groove is perpendicular to the sliding direction of the mating terminal.

BRIEF DESCRIPTION OF DRAWINGS

FIG. 3 shows the embodiment of the present invention and is a perspective view of a terminal.

DESCRIPTION OF EMBODIMENTS

Hereinafter, an embodiment of the present invention will be described with reference to the drawings.

Embodiment

Figure 1:
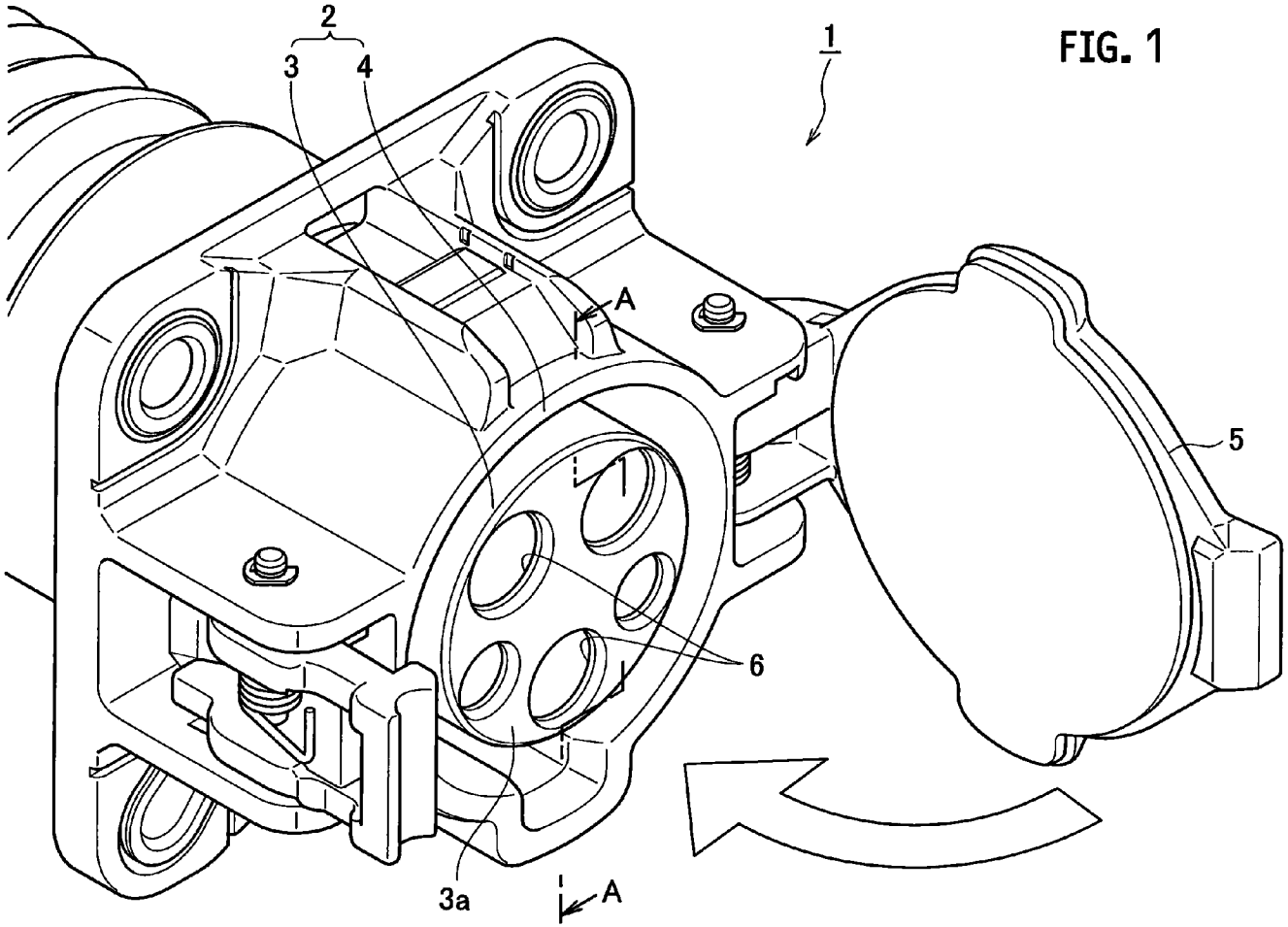
FIG. 1 shows an embodiment of the present invention and is a perspective view of a charging inlet device.
Figure 2:
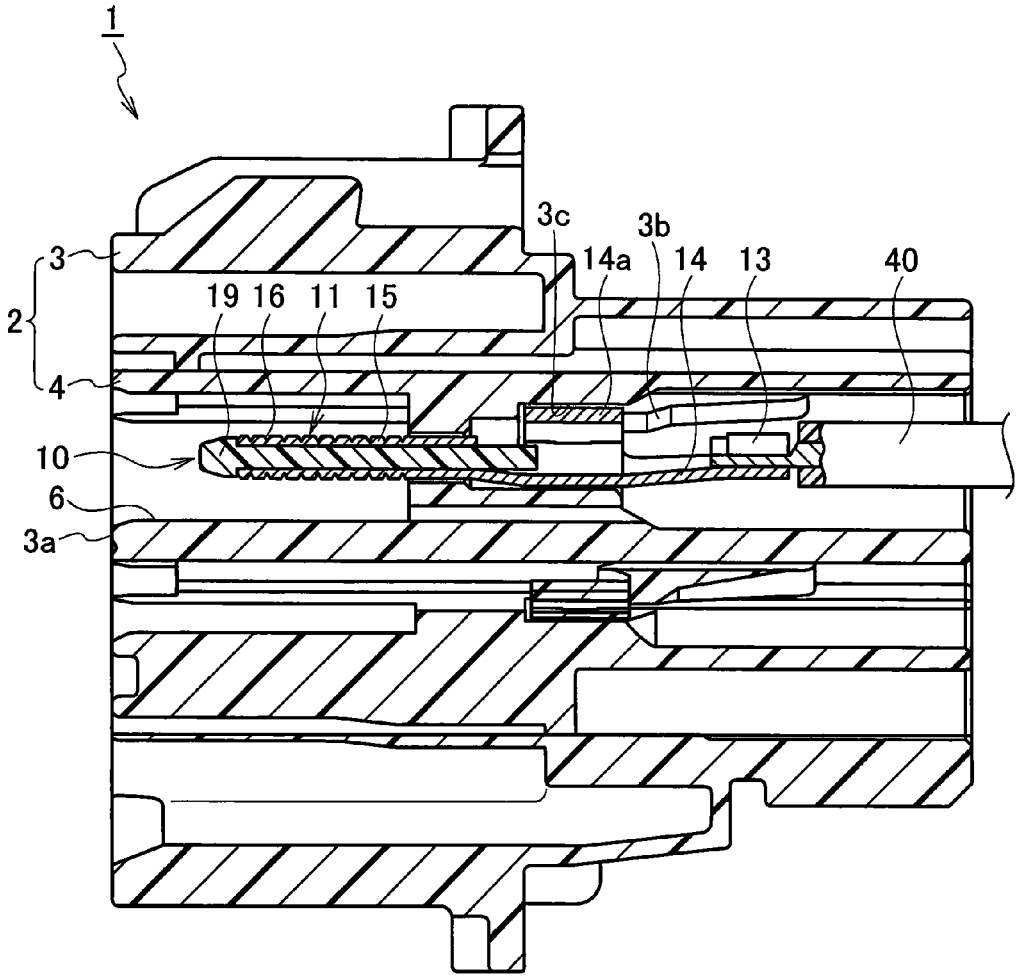
FIG. 2 shows the embodiment of the present invention and is a cross-sectional view taken along a line A-A in FIG. 1.

FIGS. 1 and 2 show the embodiment of the present invention. In the embodiment, a terminal according to the present invention is applied to a terminal of a charging inlet device. Hereinafter, the embodiment will be described.

As shown in FIGS. 1 and 2, a charging inlet device 1 includes an inlet housing 2 formed of an insulating material. The inlet housing 2 includes a connector housing 3 with a circumferential side surface, an outer case 4 arranged so as to cover an outer surface of the connector housing 3, and a cap 5 which is rotatably supported on one end side of the outer case 4 and opens and closes a front surface of the connector housing 3 as well as a front surface of the outer case 4.

The connector housing 3 is provided with five mating housing insertion holes 6 that open in a front wall 3*a*. The mating housing insertion hole 6 has two sizes of small and large corresponding to the sizes of terminals 10 described below. The terminal 10 is inserted into each mating housing insertion hole 6.

As shown in detail in FIG. 3, the terminal 10 includes a conductive terminal main body 11 and a partially exposed insulating portion 19 arranged at the tip of the terminal main body 11. The terminal main body 11 is formed by folding a metal plate having a desired shape by press working. The terminal 10 includes a male sliding contact portion 15 with which a mating terminal 30 (shown in FIGS. 4A and 4B) comes into contact, an electric cable connecting portion 13 to which an electric cable 40 is connected by swaging, and a coupling portion 14 that couples between the sliding contact portion 15 and the electric cable connecting portion 13.

The sliding contact portion 15 has a cylindrical shape. A sliding contact portion 31 of the mating terminal 30 slides on and comes into contact with a cylindrical surface of the sliding contact portion 15. The surface of the sliding contact portion 15 is modified to improve conductivity and reduce sliding resistance. Specifically, the sliding contact portion 15 has a dissimilar material different from a material of a contact base material (terminal main body 11), the dissimilar material arranged on the surface. In the present embodiment, the contact base material is a copper alloy material, and silver plating is applied to the surface of the copper alloy. In the drawings, a silver plated portion is omitted.

Figure 4A:
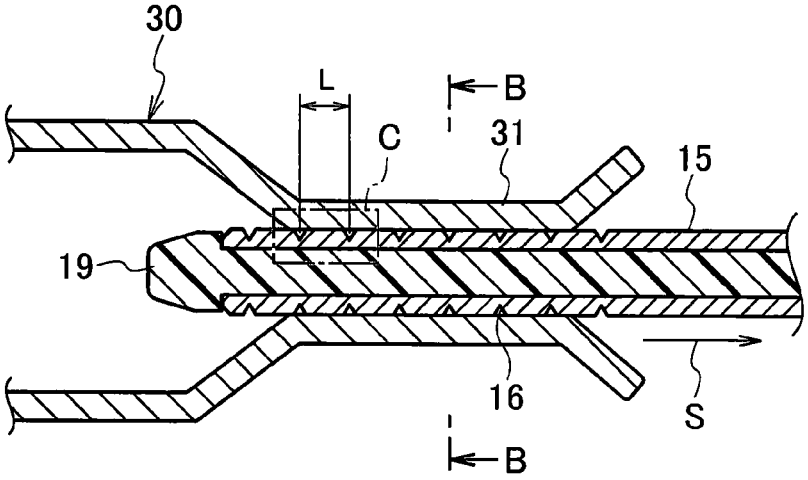
FIG. 4A shows the embodiment of the present invention and a cross-sectional view showing a contact state between a sliding contact portion of the terminal and a sliding contact portion of a mating terminal.
Figure 4B:
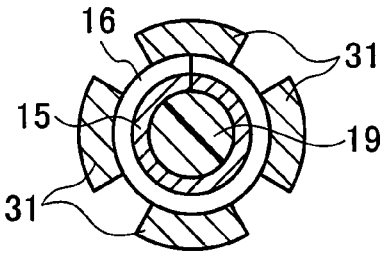
FIG. 4B shows the embodiment of the present invention and is a cross-sectional view taken along a line B-B in FIG. 4A.
Figure 4C:
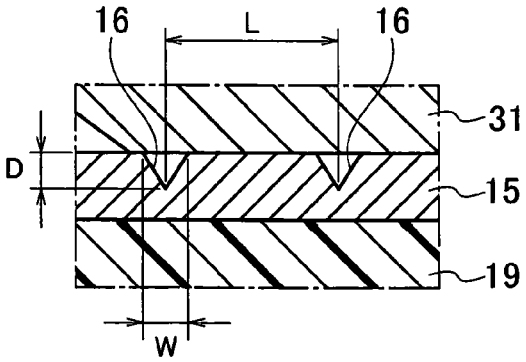
FIG. 4C shows the embodiment of the present invention and is a partial enlarged view of a portion C in FIG. 4A.

As shown in detail in FIGS. 4A, 4B, and 4C, the sliding contact portion 15 is provided with a plurality of grooves 16 on the whole circumference. Each groove 16 is arranged in a direction different from a sliding direction S of the mating terminal, specifically, arranged in a direction perpendicular to the sliding direction S. The plurality of grooves 16 is arranged at approximately equal intervals L. The interval L is set to a length in which abrasion powder due to adhesion (hereinafter referred to as adhesion abrasion powder) does not grow to a level where the adhesion abrasion powder causes significant increase in the sliding resistance. The width W and the depth D of each groove 16 are set to a length allowing the adhesion abrasion powder to enter the groove 16.

The coupling portion 14 includes a quadrangular fixing box 14*a*. As shown in FIG. 2, the fixing box 14*a* is fitted into a terminal fitting chamber 3*c* of the connector housing 3. Thereby, the terminal 10 is prevented from rotating so that the terminal 10 does not rotate in the connector housing 3. A lance 3*b* of the connector housing 3 is locked to a rear end surface of the fixing box 14*a*. Thereby, the terminal 10 is prevented from moving toward the rear end of the connector housing 3, in other words, prevented from slipping out.

The mating terminal 30 is arranged in a connector housing (not shown in the drawings) of a charging connector (not shown in the drawings). As shown in FIGS. 4A and 4B, the mating terminal 30 is a female terminal, and comes into contact with the sliding contact portion 15 by pressure of a leaf spring and slides between the mating terminal 30 and the sliding contact portion 15. The surface of the sliding contact portion 31 of the mating terminal 30 is also modified as with the terminal main body 11.

In the configuration described above, a mating housing (not shown in the drawings) of the charging connector (not shown in the drawings) is fitted to the connector housing 3 of the charging inlet device 1. Then, the mating housing is inserted into each mating housing insertion hole 6 and the mating terminal 30 is fitted to a mating terminal connection portion of the terminal 10 (a portion including the sliding contact portion 15 on the tip side of the coupling portion 14 in the terminal main body 11). In this fitting process, both sliding contact portions 15 and 31 slide with respect to each other and the adhesion abrasion powder is generated.

Here, even if the adhesion abrasion powder is generated, when the adhesion abrasion powder crosses the groove 16 of the sliding contact portion 15, growth of the adhesion abrasion powder once stops here and particles of the adhesion abrasion powder do not grow to large particles. Further, the adhesion abrasion powder that is generated on the sliding contact portions 15 and 31 enters the grooves 16, so that a ratio of the adhesion abrasion powder located on the surfaces of the sliding contact portions 15 and 31 is suppressed to a low level. Therefore, the probability that the adhesion abrasion powder lies between both sliding contact portions 15 and 31 decreases. Therefore, even if the adhesion abrasion powder lies between both sliding contact portions 15 and 31, only small particles of the adhesion abrasion powder lie between both sliding contact portions 15 and 31. By the effects described above, it is possible to prevent the increase in the sliding resistance caused by the adhesion abrasion powder as much as possible.

The direction of the groove 16 is perpendicular to the sliding direction S of the mating terminal 30. Therefore, the largest number of the grooves 16 with respect to a predetermined terminal sliding stroke can be arranged, so that it is possible to effectively suppress the growth of the adhesion abrasion powder.

Another Embodiment

Figure 5:
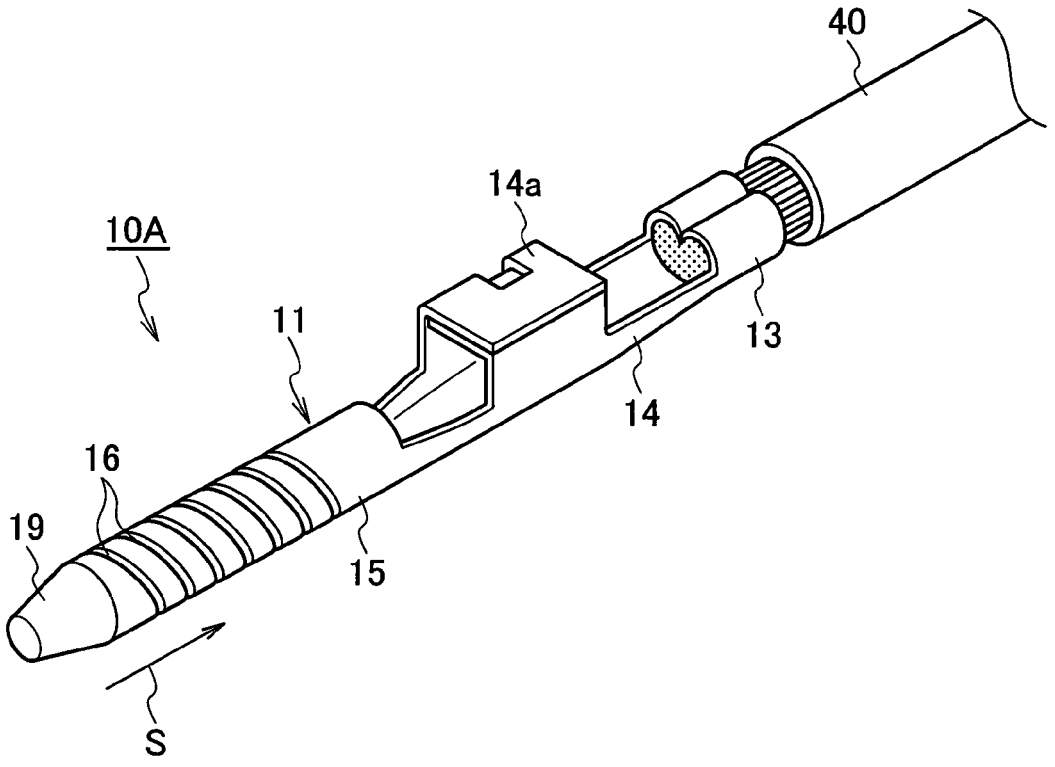
FIG. 5 shows another embodiment of the present invention and is a perspective view of a terminal.

FIG. 5 shows another embodiment of the present invention. A terminal 10A of the other embodiment is different from the terminal 10 of the embodiment described above only in the inclination direction of the grooves 16. The grooves 16 are set not in a direction perpendicular to but in a direction inclined from the sliding direction S of the mating terminal. The inclination angle is an angle at which a sliding tip of the sliding contact portion of the mating terminal crosses at least once and passes through the groove 16.

The other components are the same as those of the embodiment described above, so that the same components in FIG. 5 are given the same reference numerals and the description thereof is omitted.

Also in the other embodiment, even if the adhesion abrasion powder is generated in a sliding process between both sliding contact portions 15 and (not shown), when the adhesion abrasion powder crosses the groove 16 of the sliding contact portion 15, growth of the adhesion abrasion powder once stops here, so that the same effects as those of the embodiment described above can be obtained.

Modified Example

In the embodiments described above, the surface modification for the sliding contact portion 15 is performed by applying a plating process, but it may be performed by a cladding process (attaching a material different from a terminal base material), and may be performed by any method.

INDUSTRIAL APPLICABILITY

According to the present invention, even if both sliding contact portions slide with respect to each other and the abrasion powder due to adhesion is generated, when the abrasion powder due to adhesion crosses the groove of the sliding contact portion, growth of the abrasion powder once stops here and particles of the adhesion abrasion powder do not grow to large particles. Further, the adhesion abrasion powder that is generated on the surfaces of the sliding contact portions enters the grooves, so that the ratio of the adhesion abrasion powder located on the surfaces of the sliding contact portions is suppressed to a low level. Therefore, the probability that the adhesion abrasion powder lies between both sliding contact portions decreases, and if the adhesion abrasion powder lies between both sliding contact portions, only small particles of the adhesion abrasion powder lie between both sliding contact portions. Thereby, it is possible to prevent the increase in the sliding resistance caused by the abrasion powder due to adhesion as much as possible.

REFERENCE SIGNS LIST

10, 10A terminal
sliding contact portion groove
mating terminal
S sliding direction

The invention claimed is:

1. A terminal having a dissimilar material different from a contact base material, the dissimilar material arranged on a surface of a sliding contact portion on which a mating terminal slides, the terminal comprising, a plurality of adhesion abrasion powder catching grooves provided in the sliding contact portion in a direction different from a sliding direction of the mating terminal, wherein the plurality of adhesion abrasion powder catching grooves is provided on a whole circumference and on an entire sliding range of the sliding contact portion on which the mating terminal slides, the plurality of adhesion abrasion powder catching grooves is provided at approximately equal intervals along the sliding direction of the mating terminal, the plurality of the adhesion abrasion powder catching grooves catches an abrasion powder generated from repeated sliding between the mating terminal and the surface of the sliding contact portion, the direction of the plurality of adhesion abrasion powder catching grooves is perpendicular to the sliding direction of the mating terminal, the plurality of adhesion abrasion powder catching grooves is arranged at predetermined intervals, and a width of each of the plurality of adhesion abrasion powder catching grooves is smaller than the predetermined intervals.

2. The terminal according to claim 1, wherein the contact base material comprises a copper alloy material.

3. The terminal according to claim 1, wherein the predetermined intervals are set to a length to reduce a growth of the adhesion abrasion powder, the growth of the adhesion abrasion powder causing an increase in a sliding resistance between the sliding contact portion and the mating terminal.

4. The terminal according to claim 1, wherein the adhesion abrasion powder crosses one or more of the plurality of adhesion abrasion powder catching grooves of the sliding contact portion and a growth of the adhesion abrasion powder is stopped.

5. The terminal according to claim 4, wherein the adhesion abrasion powder crosses one or more of the plurality of adhesion abrasion powder catching grooves of the sliding contact portion and a growth of a particle size of the adhesion abrasion powder to a large particle size is prevented.

6. The terminal according to claim 5, wherein the adhesion abrasion powder enters the one or more of the plurality of adhesion abrasion powder catching grooves such that a ratio of the adhesion abrasion powder located on the surfaces of the sliding contact portion and the mating terminal and in the one or more of the plurality of adhesion abrasion powder catching grooves is suppressed.

7. The terminal according to claim 5, wherein the adhesion abrasion powder enters one or more of the plurality of adhesion abrasion powder catching grooves such that only small particles of the adhesion abrasion powder lie between the sliding contact portion and the mating terminal.

* * * * *